US009822566B2

(12) United States Patent
Seles

(10) Patent No.: US 9,822,566 B2
(45) Date of Patent: Nov. 21, 2017

(54) SPRING ACTUATED ENGAGEMENT DEVICE

(71) Applicant: OPEN ART LTD., Or Akiva (IL)

(72) Inventor: Moshe Seles, Hadera (IL)

(73) Assignee: Open Art Ltd., Or Akiva (IL)

( * ) Notice: Subject to any disclaimer, the term of this patent is extended or adjusted under 35 U.S.C. 154(b) by 0 days.

(21) Appl. No.: 14/910,470

(22) PCT Filed: Aug. 6, 2014

(86) PCT No.: PCT/IL2014/050710

§ 371 (c)(1),
(2) Date: Feb. 5, 2016

(87) PCT Pub. No.: WO2015/019353

PCT Pub. Date: Feb. 12, 2015

(65) Prior Publication Data

US 2016/0177606 A1 Jun. 23, 2016

(30) Foreign Application Priority Data

Aug. 8, 2013 (IL) ..... 227894

(51) Int. Cl.

| | |
|---|---|
| ***E05D 7/12*** | (2006.01) |
| ***E05D 5/00*** | (2006.01) |
| ***E05D 3/16*** | (2006.01) |

(52) U.S. Cl.

CPC ..... *E05D 7/12* (2013.01); *E05D 3/16* (2013.01); *E05D 5/00* (2013.01); *E05Y 2600/53* (2013.01); *E05Y 2900/131* (2013.01)

(58) Field of Classification Search

CPC ..... E05D 7/10; E05D 7/1011; E05D 7/12; E05D 7/123; E05Y 2900/131

(Continued)

(56) References Cited

U.S. PATENT DOCUMENTS 4,430,771 A 2/1984 Salice
4,799,290 A 1/1989 Lautenschlager, Jr.

(Continued)

FOREIGN PATENT DOCUMENTS

DE 3934337 A1 4/1991
DE 4018235 C2 12/1991

(Continued)

OTHER PUBLICATIONS

International Search Report from a counterpart foreign application—PCT/IL2014/050710—5 pages, dated Nov. 18, 2014.

(Continued)

*Primary Examiner* — Daniel Wiley
(74) *Attorney, Agent, or Firm* — Roach Brown McCarthy & Gruber, P.C.; Kevin D. McCarthy

(57) ABSTRACT

A spring actuated engagement device for remotely coupling a movable member to a stationary member comprises a fixture mountable onto a stationary member, a spring biased bar that is axially displaceable within a central recess formed within the fixture, an abutting element extending outwardly from the bar for actuating the spring, and a seating element outwardly spaced from the fixture and longitudinally spaced from the abutting element. The abutting element is axially displaceable in a first direction when contacted by a first edge of a movable member, allowing a second edge of the movable member to be received in an interspace between the seating element and the outer face, and to be axially displaced in a second direction after a force that initiated the contact with the first edge is released. A pivotally displaceable locking device, when set to a locked condition, prevents displacement of the actuator.

20 Claims, 8 Drawing Sheets

(58) Field of Classification Search
USPC ..... 16/254, 257, 258
See application file for complete search history.

(56) References Cited

U.S. PATENT DOCUMENTS

| | | | | |
|---|---|---|---|---|
| 4,839,940 | A | 6/1989 | Grass | |
| 4,881,297 | A | 11/1989 | Grass | |
| 5,022,116 | A | 6/1991 | Salice | |
| 5,210,907 | A * | 5/1993 | Toyama | E05D 7/0407 16/251 |
| 5,224,242 | A | 7/1993 | Marjanovic | |
| 5,343,595 | A | 9/1994 | Lautenschlager | |
| 5,937,479 | A * | 8/1999 | Ohshima | E05D 7/125 16/257 |
| 6,035,489 | A * | 3/2000 | Adams | E05D 7/1011 16/229 |
| 6,339,864 | B1 | 1/2002 | Albrecht et al. | |
| 7,322,072 | B2 * | 1/2008 | Lin | H05K 5/0221 16/252 |
| 7,383,615 | B2 * | 6/2008 | Pozzi | E05D 5/08 16/258 |
| 7,401,380 | B2 * | 7/2008 | Herring | H05K 5/0226 16/257 |
| 7,653,422 | B2 * | 1/2010 | Roberts | H04M 1/0237 16/14 |
| 2002/0046441 | A1 * | 4/2002 | Brustle | E05F 5/006 16/254 |
| 2004/0216272 | A1 | 11/2004 | Booker et al. | |
| 2005/0172451 | A1 | 8/2005 | Kashiwaguma | |
| 2008/0022491 | A1 * | 1/2008 | Campbell | E05D 7/0423 16/236 |

FOREIGN PATENT DOCUMENTS

| | | |
|---|---|---|
| GB | 2322667 | 9/1998 |
| JP | 02176085 | 7/1990 |
| WO | 98/45560 A1 | 10/1998 |

OTHER PUBLICATIONS

Written Opinion of International Searching Authority from a counterpart foreign application—PCT/IL2014/050710—6 pages, dated Nov. 18, 2014.

International Preliminary Report on Patentability from a counterpart foreign application—PCT/IL2014/050710—20 pages, dated Dec. 22, 2014.

Communication and Supplementary European Search Report for a counterpart foreign application—EP 14 83 5317—dated Mar. 10, 2017 (8 pages).

* cited by examiner

SPRING ACTUATED ENGAGEMENT DEVICE

FIELD OF THE INVENTION

The present invention relates to the field of engagement devices. More particularly, the invention relates to a spring actuated engagement device.

BACKGROUND OF THE INVENTION

The coupling of two elements together at inaccessible, hard to reach areas is often a laborious and time consuming task, requiring the user to access the engagement location from a distance in order to ensure that the elements will be successfully mated together.

It is an object of the present invention to provide an engagement device by which two elements may be mechanically coupled together or separated while a user is disposed at a distance from the engagement location.

It is an additional object of the present invention to provide an engagement device by which two elements are reliably coupled together.

Other objects and advantages of the invention will become apparent as the description proceeds.

SUMMARY OF THE INVENTION

The present invention provides a spring actuated engagement device for remotely coupling a movable member to a stationary member, comprising a fixture mountable onto a stationary member, a spring biased bar that is axially displaceable within a central recess formed within said fixture, an abutting element extending outwardly from one end of said bar for actuating said spring, at least one seating element outwardly spaced from an outer face of said fixture and longitudinally spaced from said abutting element, wherein said abutting element is configured to be axially displaced in a first direction when contacted by a first terminal edge of a movable member, allowing a second terminal edge of said movable member longitudinally spaced from said first edge to be receivable in an interspace between said at least one seating element and said outer face, and to be axially displaced in a second direction opposite to said first direction after a force that initiated said contact with said first edge is released, whereby to engage said movable member.

In one aspect, the fixture is rectilinear and has first and second terminal faces substantially perpendicular to the outer face, a border element being formed between said first terminal face and the central recess to limit displacement of the abutting element in the first direction.

In one aspect, the at least one seating element longitudinally extends from the second terminal face, allowing the movable member to be longitudinally engageable by the abutting element and a portion of said additional face adjoining the at least one seating element and to be transversally engageable by the fixture outer face and the at least one seating element.

In one aspect, the fixture has two side faces and further comprises a corresponding guide element outwardly and laterally protruding from each of said side faces to laterally engage the movable member. The guide element may be formed with a guiding surface for urging the movable member to a correct lateral alignment when the abutting element is being axially displaced in the first direction if said guiding surface is inadvertently contacted by a portion of the movable member.

As referred to herein, the abutment element is axially displaceable in a "longitudinal" direction, the side faces of the fixture are spaced in the "lateral" direction, and the outer face is spaced from the stationary member in the "transversal" direction.

In one aspect, a spring housing, which may longitudinally extend to the abutting element, protrudes outwardly from the bar and the spring retained within said housing is attached at one end to a base of the bar and at another end to a securing element extending outwardly from an inner face of the fixture which borders the central recess. A positioning element fitted in the base of the bar is adapted to contact an edge of an aperture formed in the inner face, to limit displacement of the bar in the second direction.

In one aspect, a position indicating element extends in the second direction from the abutting element to define an interspace between said position indicating element and the spring housing for positioning the movable member first edge when the abutting element is being axially displaced in the first direction. The position indicating element may be formed with an outer guiding surface for urging the movable member first edge into a correct alignment within the interspace between the position indicating element and the spring housing if the movable element is incorrectly transversally aligned.

In one aspect, the engagement device further comprises a locking device for preventing longitudinal displacement of the abutting element once the movable member is engaged.

In one aspect, the locking device is pivotally displaceable and releasably engages the border element when displaced to a locking position.

In one aspect, the first terminal face transversally extends inwardly from the outer face and is sufficiently thicker than the side faces to receive a pin in an aperture formed therein, the locking device being pivotable about said pin.

The present invention is also directed to a locking device for preventing displacement of an actuator, comprising first and second spaced and substantially mutually parallel elements, an end wall extending between said first and second elements, a handle spaced from said end wall, and a pin extending from a terminal portion of said first element into an aperture formed in a fixture and about which said locking device is pivotally displaceable, wherein, when said locking device is set to a locked condition, said first and second elements are sized to engage a border element of said fixture therebetween and said second element is positioned in abutment with said actuator to prevent actuator displacement in a direction between said first and second elements.

DETAILED DESCRIPTION OF PREFERRED EMBODIMENTS

The engagement device of the present invention allows two members, a stationary member and a movable member, to be mechanically coupled together while a user is disposed at a distance from the engagement location. The engagement device has a spring biased bar that slides in the direction of displacement of the movable member, and a seat for receiving and immobilizing an element of the movable member.

Figure 7:
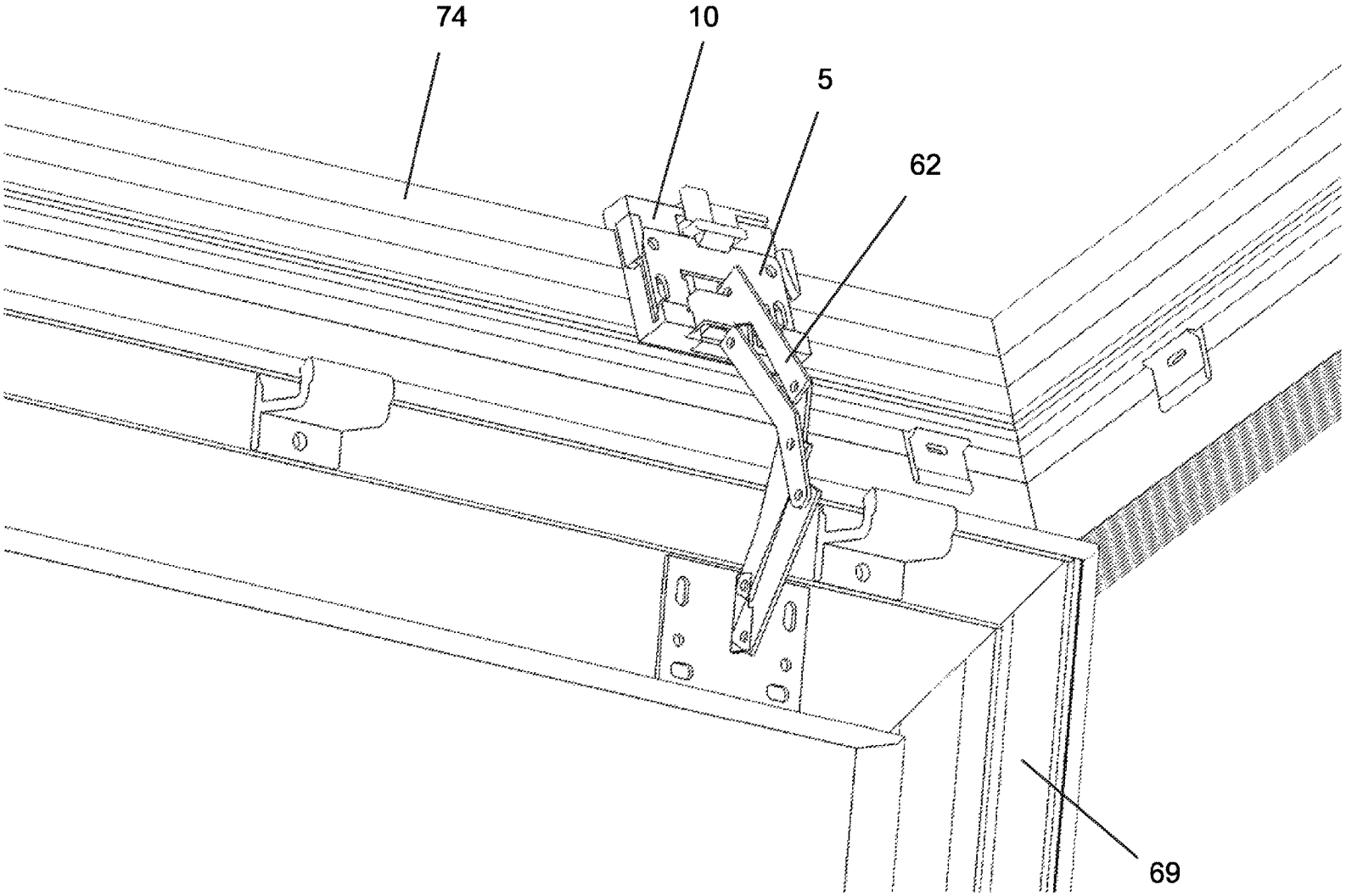
FIG. 7 is a perspective view of the engagement device of FIG. 1, shown when an exemplary movable member is engaged therewith.
Figure 8:
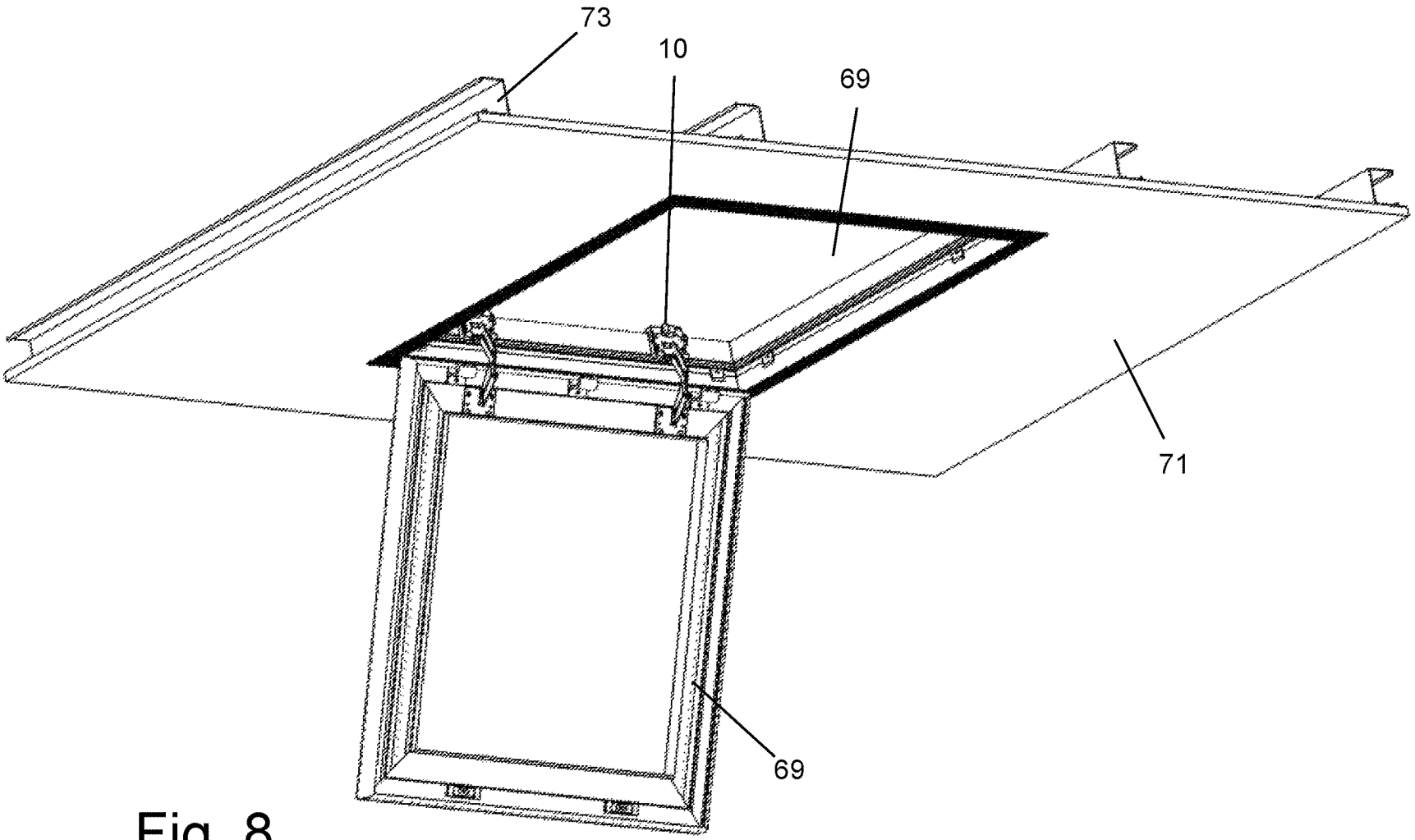
FIG. 8 is a perspective view of the movable member of FIG. 7, shown in an opened condition.

FIGS. 7 and 8 illustrate a vertically disposed engagement device 10, according to one embodiment of the present invention, with which is engaged a rectilinear bracket 5 of an angled arm 62 mounted onto an exemplary movable member embodied by a pivotal service hatch 67 for selectively occluding a passageway 69 through which a building related component, including but not limited to an electrical component, an air conditioner, a roller blind box, can be accessed. An exemplary stationary member is a plaster plate 71 mounted onto a ceiling by a plurality of aluminum beams 73. When two engagement devices 10 are mounted on the same plaster plate sidewall 74 bordering passageway 69, hatch 69 is able to pivot more 90 degrees, and up to 150 degrees by virtue of the configuration of angled arms 62.

It will be appreciated that the present invention is also applicable to an engagement device that is configured to interface with any other configured stationary and movable members.

Figure 1:
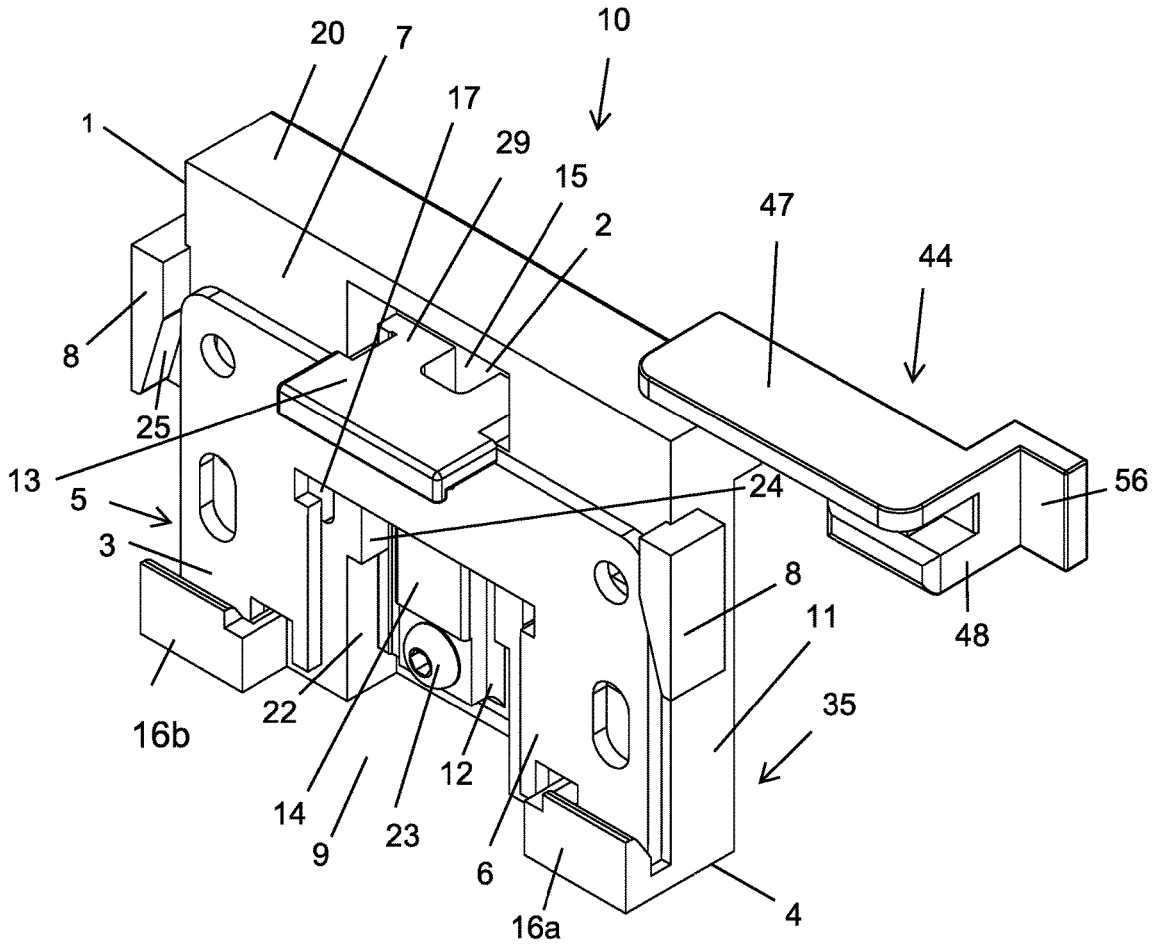
FIG. 1 is a perspective view of an engagement device according to one embodiment of the present invention, shown in an unlocked condition.

FIG. 1 illustrates a front view of an unlocked engagement device 10, when a thin, inverted U-shaped bracket 5 of a movable member is in engagement therewith.

Engagement device 10 has a rectilinear fixture 35 configured with an outer face 7, i.e. facing away from the stationary member onto which it is mounted, opposed side faces 1 and 11, an upper face 20 substantially perpendicular to outer face 7, and a central recess 9 which is recessed with respect to outer face 7, to accommodate the sliding vertical movement of rectangular, spring biased bar 12. Abutting element 13 substantially perpendicular to bar 12 extends outwardly from the top thereof. A rectilinear guide element 8 with an oblique guiding surface 25 may protrude laterally, i.e. in a direction away from the central recess, from a corresponding side face, and also outwardly from outer face 7.

This description refers to an engagement device when the abutting element is disposed at the top of the spring biased bar. It will be appreciated, however, that the invention is also applicable when the engagement device assumes any other suitable orientation.

Seating elements 16*a-b* protrude upwardly from the stepped engagement device bottom face 4 (see FIG. 3), and are spaced outwardly from the bottom of side faces 1 and 11, respectively, extending laterally therefrom for a limited distance towards recess 9. The length of each seating element is slightly longer than the lateral dimension of foot 3, at the bottom of each leg 6 of bracket 5.

Figure 2:
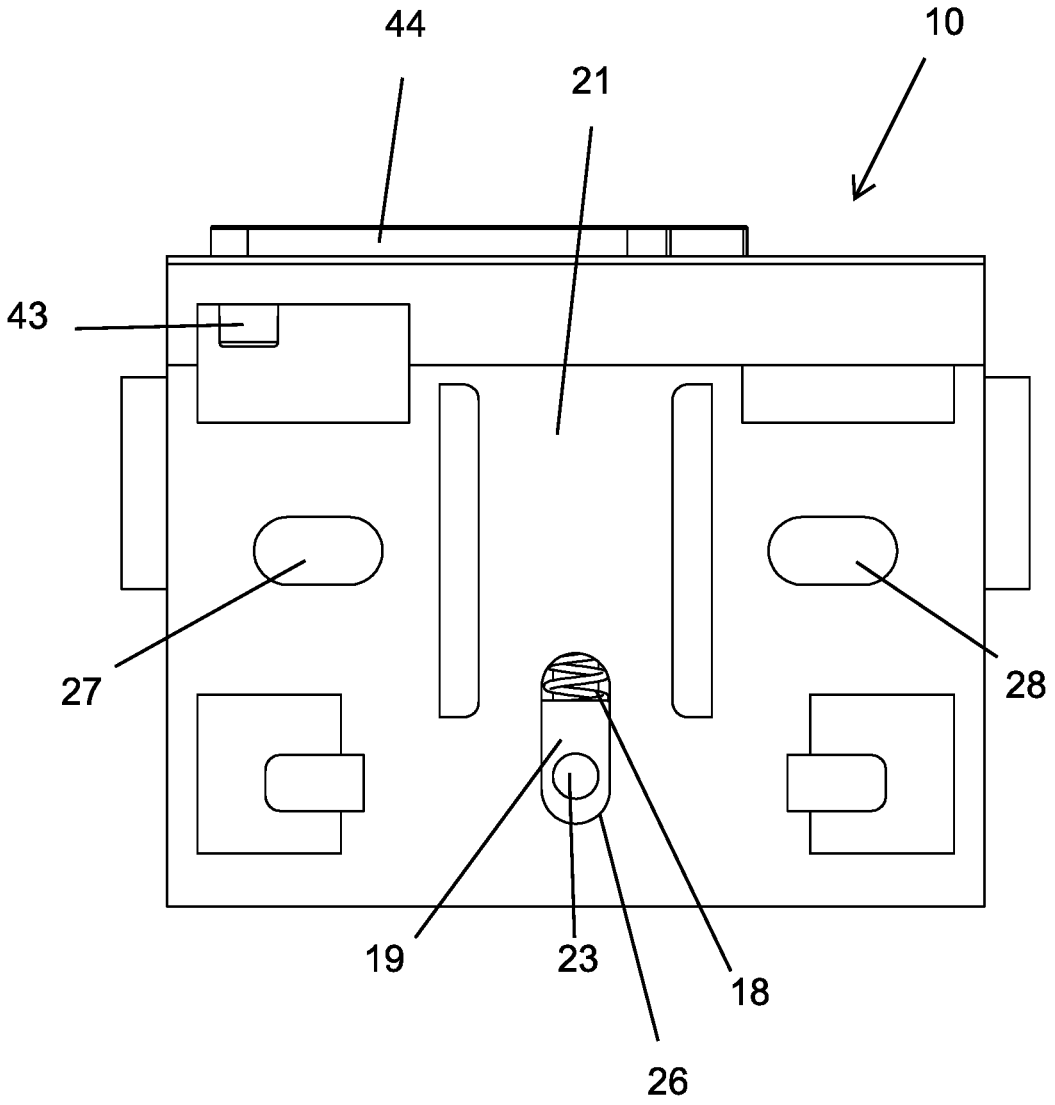
FIG. 2 is a rear view of the engagement device of FIG. 1, shown in a locked condition.

Engagement device 10 may be mounted onto the stationary member by a bolt or any other suitable fastening element insertable within apertures 27 and 28, shown in FIG. 2 at the rear of engagement device 10. Apertures 27 and 28 may be formed in a corresponding recess 17 formed in outer face 7.

Figure 6:
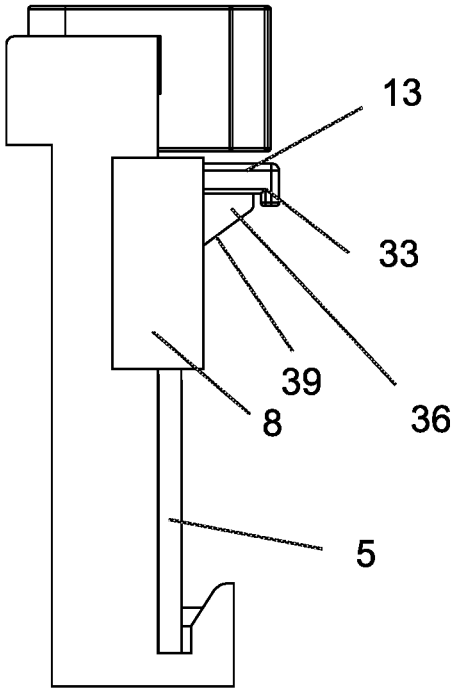
FIG. 6 is a side view of the engagement device of FIG. 1, shown in a locked condition.

As shown in FIGS. 1, 2 and 6, abutting element 13 is a thin, relatively large-surface element that is contactable by bracket 5 of the movable member and serves as an actuator for the spring. Abutting element 13, which may be bifurcated by narrow extending elements 29 when viewed from above or from below, protrudes outwardly beyond the guide elements 8 and extends inwardly to the inner face 15 of central recess 9, although is separated therefrom.

A lip 33 may slightly extend downwardly from the outer edge of abutting element 13. A position indicating element 36, e.g. of triangular cross section, extends downwardly from the underside of abutting element 13 between bifurcated extending elements 29 and lip 33, to define a guiding surface 39.

Protruding outwardly from bar 12 is a spring housing 14, in which is housed spring 18 shown in FIG. 2. The bottom end of spring 18 is attached to base 19 of bar 12 by horizontal pin 23, and the top end of the spring is attached to a securing element extending outwardly from rear face 21 of the engagement device. The securing element may be positioned within a cavity 2 formed at an inner region of abutting element 13. A positioning element 23, e.g. a pin, fitted horizontally in base 19 is adapted to contact the bottom of oval aperture 26 formed in rear face 21, to limit the downward displacement of bar 12.

Figure 4:
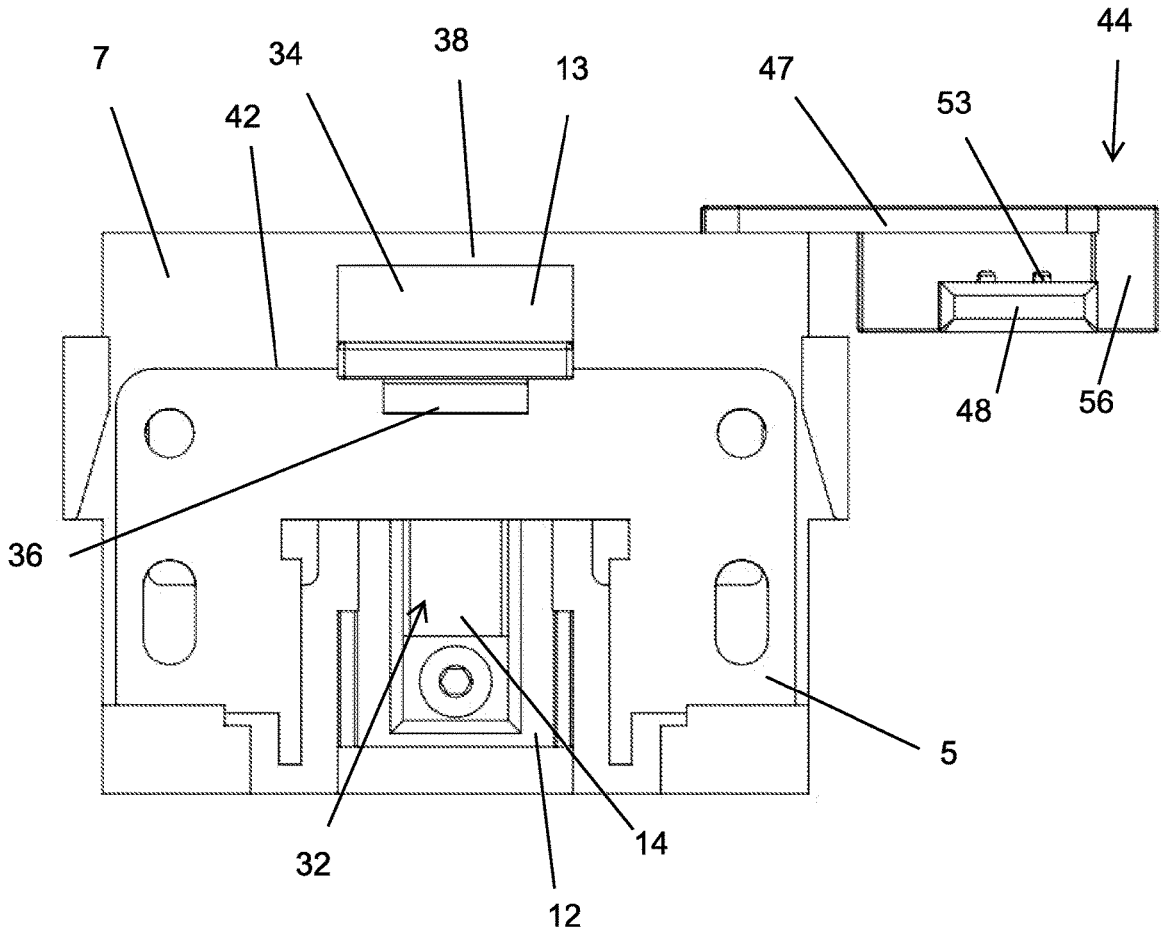
FIG. 4 is a rear view of the engagement device of FIG. 1, shown in an unlocked condition.

Referring also to FIG. 4, abutting element 13 divides central recess 9 into a lower chamber 32 within which bar 12 is slidingly displaceable and an upper chamber 34 within which abutting element 13 is displaceable. Spring 18 is biased to cause bar 12 and abutting element 13 attached thereto to be displaced downwardly when a force is released from abutting element 13. When abutting element 13 is downwardly biased, upper chamber 34 is unobstructed, making upper border element 38 of outer face 7 which borders upper chamber 34 to become accessible.

Figure 3:
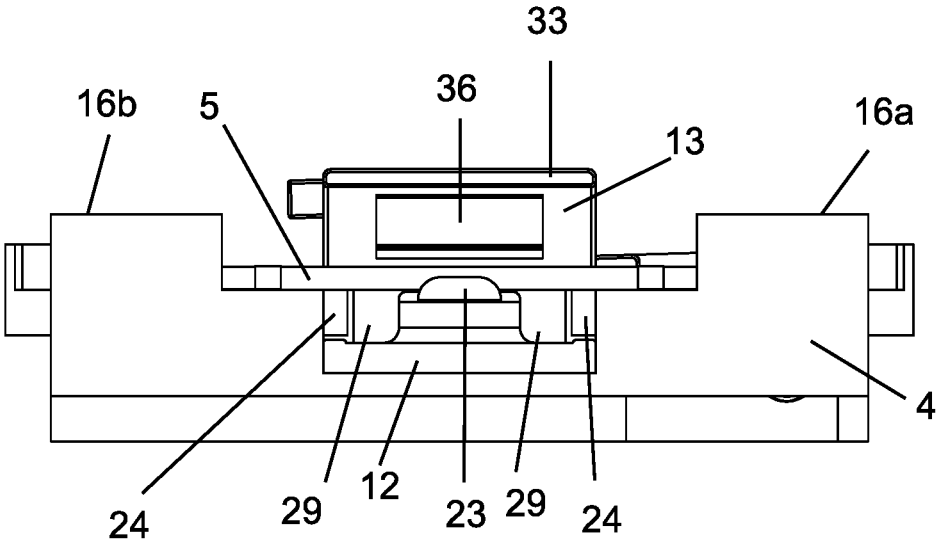
FIG. 3 is a bottom view of the engagement device of FIG. 1, shown in a locked condition.

Although bar 12 is longitudinally slidable within central recess 9, detachment of bar 12 from engagement device 10 is prevented by means of a plurality of teeth 24, e.g. having a rectangular profile, which protrude inwardly into recess 9 from a corresponding sidewall 22 of the latter, to contact bar 12, as shown in FIGS. 1 and 3, for example when abutting element 13 is pulled outwardly. Abutting element 13 may be notched at lateral ends thereof, to prevent interference with teeth 24.

In operation, a user wishing to couple bracket 5 of the movable member to engagement device 10 directs upper edge 42 of bracket 5 to contact the portion of abutting element 13 between spring housing 14 and triangular position indicating element 36, and applies an upward force to bracket 5. Abutting element 13 is therefore displaced upwardly to the vicinity of upper border element 38, providing a clearance between each bracket foot 3 and a corresponding seat 16. Due to the presence of seating elements 16*a* and 16, bracket 5 is held obliquely with respect to outer face 7 during upward displacement of abutting element 13, and then each bracket foot 3 is inwardly displaced to contact outer face 7 after the clearance is produced. When the applied force is released, each bracket foot 3 is received in the interspace between a seat and a corresponding side face. Bracket 5 is consequently engaged from the top by abutting element 13, from the bottom by bottom face 4, inwardly by outer face 7, outwardly by seating elements 16*a* and 16 and by position indicating element 36, and to either lateral side by a corresponding guide element 8.

If the user does not properly position the bracket upper edge 42, guiding surfaces 25 and 39 urge bracket 5 into a correct alignment. That is, guiding surface 39 will urge bracket upper edge 42 downwardly to a correct position inwardly of position indicating element 36 if bracket upper edge 42 incorrectly contacts guiding surface 39. Also, an inclined guiding surface 25 will urge the bracket to a correct lateral alignment if it is contacted by a bracket portion.

When it is desired to detach or replace the movable member, a force is simply transmitted from the bracket to the abutting element to cause the latter to be upwardly displaced, after which the bracket is removed from the engagement device.

To prevent inadvertent displacement of the abutting element, locking device 44 shown particularly in FIGS. 1, 2, 4 and 5 may be used.

Figure 5:
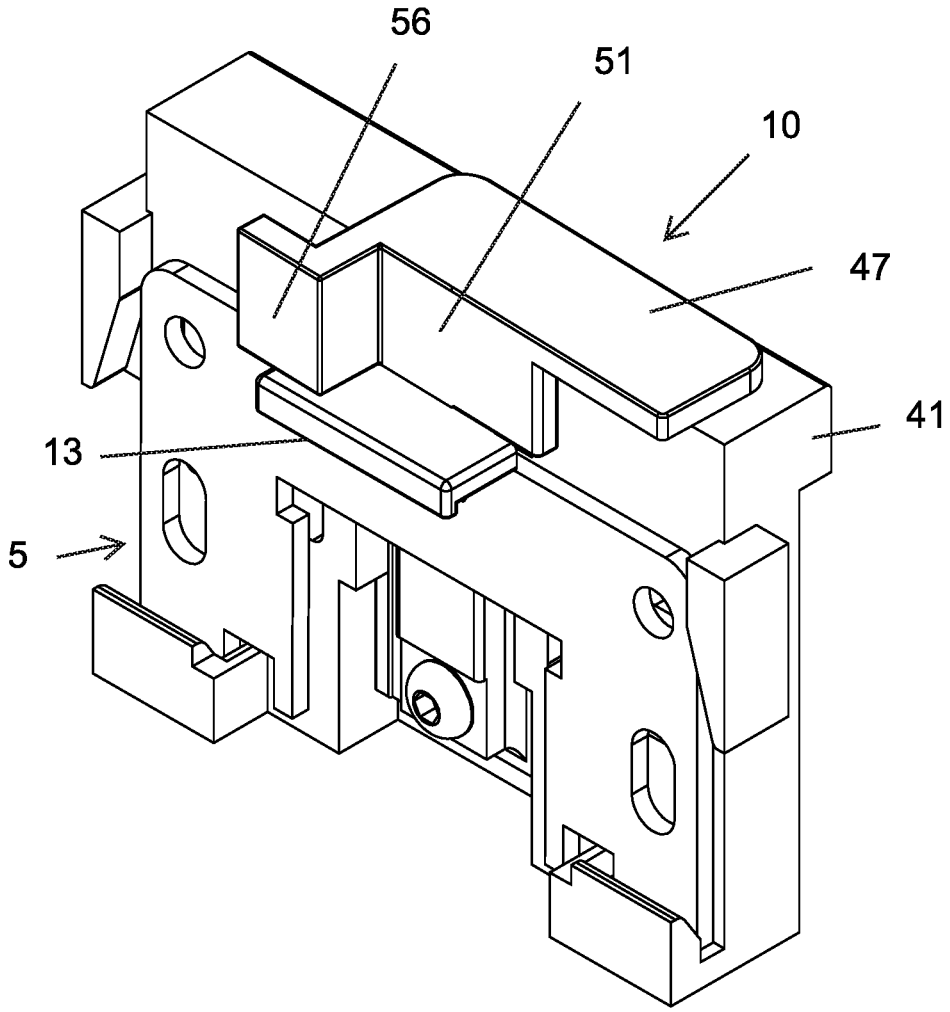
FIG. 5 is a perspective view of the engagement device of FIG. 1, shown in a locked condition.

Plastically deformable locking device 44 comprises an upper element 47 and a lower element 48 which are substantially parallel to engagement device upper face 20, a vertical wall 51 extending between upper element 47 and lower element 48, and a handle 56 spaced outwardly from vertical wall 51 when locking device 44 is positioned to a locked condition, as shown in FIG. 5. Lower element 48 is significantly narrower and shorter than upper element 47. Protruding upwardly from lower element 48 are a plurality of frictionally engageable elements 53. The spacing between the bottom face of upper element 47 and frictionally engageable elements 53 is slightly less than the thickness of upper border element 38.

Locking device 44 is pivotally displaceable about a vertical pin 43 insertable in an aperture formed in upper face 20 of thickened service element 41, which is provided at the top of engagement device 10 and extends inwardly from outer face 7. When locking device 44 is pivoted to a locked condition by contacting vertical wall 51, upper element 47 covers a portion of border element 38, lower element 48 is received in upper chamber 34 of central recess 9, and frictionally engageable elements 53 grip the underside of border element 38 to retain engagement device 10 in the locked condition.

When engagement device 10 is in the locked condition, significant upward displacement of abutting element 13 is prevented as the latter will contact the bottom edge of lower element 48 and will not be able to be additionally displaced upwardly. The spring actuated by abutting element 13 is configured to be extended by a specific distance when bracket 5 is engaged by engagement device 10, as shown in FIG. 5, so that abutting element 13 will abut the bottom edge of lower element 48. Thus bracket 5 is positively engaged and cannot be removed from device 10 even if a force is applied to bracket 5 or to abutting element 13.

Pulling on handle 56 will cause locking device 44 to pivot to the unlocked position, enabling abutting element 13 to be upwardly displaced and bracket 5 to be removed from engagement device 10.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A spring actuated engagement device for remotely coupling a movable member to a stationary member, comprising:

a) a fixture mountable onto a stationary member such that an inner face of said fixture is in contact with said stationary member;

b) a spring biased bar that is axially displaceable within a central recess formed within said fixture;

c) an abutting element connected to, and extending outwardly from, a distal end of said bar, for actuating said spring;

d) a proximal face of said fixture extending outwardly from said inner face and protruding outwardly from an outer face of said fixture; and e) at least one seating element extending distally from said proximal face so as to be outwardly spaced from said outer face promimally spaced from said abutting element, wherein said abutting element is configured to be distally displaced when contacted by a distal terminal edge of a movable member, allowing a proximal terminal edge of said movable member longitudinally spaced from said distal edge to be receivable in an interspace between said at least one seating element and said outer face, and to be proximally displaced after a force that initiated said contact with said distal edge is released, causing said movable member to be longitudinally engaged between said abutting element and said proximal face;

wherein said fixture is additionally configured with two side faces and further comprises a corresponding guide element outwardly and laterally protruding from each of said side faces to laterally engage said movable member.

2. The engagement device according to claim 1, wherein the movable member is also transversally engageable by the fixture outer face and the at least one seating element.

3. The engagement device according to claim 1, wherein the guide element is formed with a guiding surface for urging the movable member to a correct lateral alignment when the abutting element is being axially displaced in the first direction if said guiding surface is inadvertently contacted by a portion of the movable member.

4. The engagement device according to claim 1, wherein a spring housing protrudes outwardly from the bar and the spring retained within said housing is attached at a proximal end to a base of the bar and at a distal end to a securing element extending outwardly from a region of the inner face of the fixture which borders the central recess.

5. The engagement device according to claim 4, wherein a positioning element fitted in the base of the bar is adapted to contact an edge of an aperture formed in the inner face, to limit displacement of the bar in the proximal direction.

6. The engagement device according to claim 4, wherein the spring housing longitudinally extends towards the abutting element.

7. The engagement device according to claim 6, wherein a position indicating element extends proximally from the abutting element to define an interspace between said position indicating element and the spring housing for positioning the movable member distal edge when the abutting element is being distally displaced.

8. The engagement device according to claim 7, wherein the position indicating element is formed with an outer guiding surface for urging the movable member distal edge into a correct alignment within the interspace between the position indicating element and the spring housing if the movable element is incorrectly transversally aligned.

9. The engagement device according to claim 1, wherein the fixture has a distal face which extends inwardly from the outer face, a border element being formed within the outer face between said distal face and the central recess to limit distal displacement of the abutting element.

10. The engagement device according to claim 9, wherein the fixture is rectilinear and the distal face is substantially parallel to the proximal face.

11. The engagement device according to claim 9, further comprising a locking device for preventing longitudinal displacement of the abutting element once the movable member is engaged.

12. The engagement device according to claim 11, wherein the locking device is pivotally displaceable and releasably engages the border element when displaced to a locking position.

13. The engagement device according to claim 12, wherein the locking device comprises first and second spaced and substantially mutually parallel elements, an end wall extending between said first and second elements, a handle spaced from said end wall, and a pin extending from a terminal portion of said first element into an aperture formed in the distal face and about which said locking device is pivotally displaceable, wherein, when said locking device is set to the locking position, said first and second elements are sized to engage the border element and said second element is positionable in contact with the abutting element to prevent displacement of the abutting element in a direction between said first and second elements.

14. The engagement device according to claim 13, wherein the distal face has a transversal dimension that is significantly greater than a thickness of the fixture between the inner and outer faces.

15. A method for remotely coupling a movable member to a stationary member, comprising the steps of:

a) mounting a fixture of a spring actuated engagement device onto a stationary member, wherein said engagement device comprises a spring actuator that is axially displaceable between an extreme proximal position and an extreme distal position within a central recess formed within said fixture, and at least one seating element outwardly spaced from an outer face of said fixture and proximally spaced from said actuator;

b) by a user remotely spaced from said engagement device, manipulating a movable member having a bracket until a distal edge of said bracket is brought in contact with said actuator while a proximal edge of said bracket is spaced from said at least one seating element;

c) applying a distally directed force onto said distal edge to cause distal displacement of said actuator and to produce a clearance between said proximal edge and said at least one seating element;

d) releasing said applied force until said proximal edge is received in an interspace between said at least one seating element and said fixture outer face and said bracket is rendered substantially immovable as a result of engagement with said actuator and with a surface extending between said at least one seating element and said outer face; and e) preventing axial displacement of said actuator once said bracket is engaged with said actuator and with said surface extending between said at least one seating element and said outer face by displacing a locking device to a locking position such that it releasably engages both said actuator and a border element formed within said outer face which borders said central recess.

16. The method according to claim 15, wherein the bracket is a bracket of an arm mounted on the movable member.

17. The method according to claim 15, wherein the movable member has two or more spaced brackets, and each of said two or more spaced brackets is simultaneously received in a corresponding interspace between said at least one seating element and said fixture outer face.

18. The method according to claim 15, further comprising the step of urging the movable member to a correct lateral alignment when the actuator is being distally displaced by use of two guide elements outwardly and laterally protruding from each of corresponding side faces of the fixture that are adapted to laterally engage the movable member.

19. A spring actuated engagement device for remotely coupling a movable member to a stationary member, comprising:

a) a fixture mountable onto a stationary member such that an inner face of said fixture is in contact with said stationary member;

b) a spring biased bar that is axially displaceable within a central recess formed within said fixture;

c) an abutting element connected to, and extending outwardly from, a distal end of said bar, for actuating said spring;

d) a proximal face of said fixture extending outwardly from said inner face and protruding outwardly from an outer face of said fixture; and e) at least one seating element extending distally from said proximal face so as to be outwardly spaced from said outer face and proximally spaced from said abutting element, wherein said abutting element is configured to be distally displaced when contacted by a distal terminal edge of a movable member, allowing a proximal terminal edge of said movable member longitudinally spaced from said distal edge to be receivable in an interspace between said at least one seating element and said outer face, and to be proximally displaced after a force that initiated said contact with said distal edge is released, causing said movable member to be longitudinally engaged between said abutting element and said proximal face, wherein a spring housing longitudinally extending towards said abutting element protrudes outwardly from said bar and the spring retained within said housing is attached at a proximal end to a base of said bar and at a distal end to a securing element extending outwardly from a region of said inner face which borders the central recess, wherein a position indicating element extends proximally from said abutting element to define an interspace between said position indicating element and said spring housing for positioning said movable member distal edge when said abutting element is being distally displaced.

20. The engagement device according to claim 19, wherein the fixture has two side faces and further comprises a corresponding guide element outwardly and laterally protruding from each of said side faces to laterally engage the movable member.

* * * * *